United States Patent [19]

Bauer et al.

[11] 4,001,009

[45] Jan. 4, 1977

[54] PROCESS FOR THE MANUFACTURE OF STEELS WITH A HIGH CHROMIUM CONTENT

[76] Inventors: Hannsgeorg Bauer, Buchenweg 21, 581 Witten-Bommern; Josef Otto, Am Wasserturm 5, 5802 Wetter 4 - Wengern, both of Germany

[22] Filed: Jan. 2, 1975

[21] Appl. No.: 538,204

Related U.S. Application Data

[63] Continuation-in-part of Ser. Nos. 840,073, April 3, 1969, abandoned, Ser. No. 195,424, Nov. 3, 1971, abandoned, and Ser. No. 331,541, Feb. 12, 1973, abandoned.

[52] U.S. Cl. ..... 75/13; 75/49; 75/60

[51] Int. Cl.[2] ..... C21C 5/52

[58] Field of Search ..... 75/49, 12, 13, 60

[56] References Cited

UNITED STATES PATENTS

| | | | |
|---|---|---|---|
| 2,040,566 | 5/1936 | Rohn | 75/49 X |
| 2,093,666 | 9/1937 | Vogt | 75/49 X |
| 3,083,422 | 4/1963 | Finkl | 75/49 X |
| 3,336,132 | 8/1967 | McCoy | 75/49 |
| 3,420,657 | 1/1969 | Hansen | 75/49 X |

*Primary Examiner*—M. J. Andrews

[57] ABSTRACT

Post melting unit process for the decarbonization of stainless chromium steel containing at least about 10% chromium which comprises subjecting a melt of chromium containing steel at about 1580°–1700° C to a vacuum in the presence of sufficient oxygen to lower a starting carbon content which is above the ELC range into the ELC range, and simultaneously with subjection to vacuum, agitating the melt by gas purging, the heat added to the steel by combustion of carbon at least partially compensating for the heat loss due to post melting unit treatment.

13 Claims, 5 Drawing Figures

RELATION BETWEEN TEMPERATURE AND Cr-C EQUILIBRIUM

CHROME AND CARBON CONTENTS AFTER OXYGEN BLOWING IN AN OXYGEN SURFACE-BLOWING CONVERTER IN THE MANUFACTURE OF STAINLESS TYPES OF AUSTENITIC CHROME AND NICKEL STEELS

RELATION BETWEEN CHROMIUM-CARBON MONOXIDE EQUILIBRIUM AND THE CARBON MONOXIDE PRESSURE

PROCESS FOR THE MANUFACTURE OF STEELS WITH A HIGH CHROMIUM CONTENT

This application is a continuation-in-part of Ser. No. 840073 filed Apr. 3, 1969 now abandoned, Ser. No. 195424 filed Nov. 3, 1971 now abandoned, and Ser. No. 331541 filed Feb. 12, 1973 now abandoned.

BACKGROUND

The present invention relates to the vacuum decarbonization of high-chromium and high nicket-chromium stainless steels.

Figure 1:
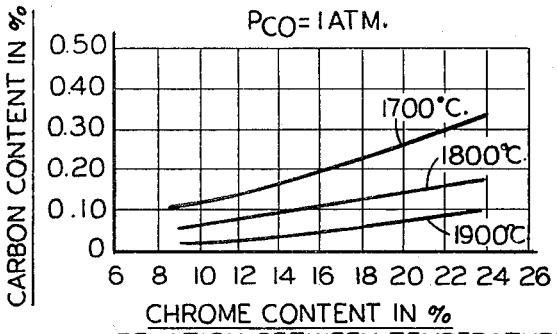
Figure 2:
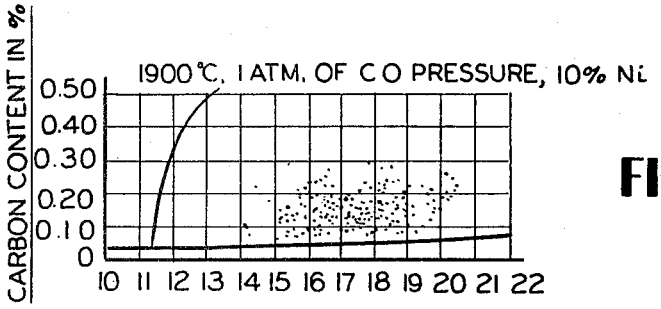
Figure 3:
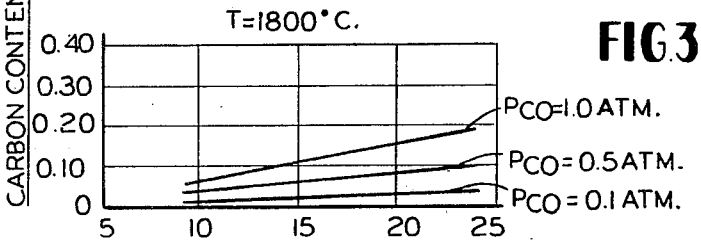

The technical interest in steels of this kind having carbon contents of less than 0.03% is due to their high corrosion-resistance. One difficulty in making them consists in the undesirable chromium slagging that occurs when oxygen is blown into or onto the surface of the hot metal, if the oxidation is continued down to the desired low final carbon content. FIG. 1 shows the limits to which the carbon can be oxidized at a given Cr content at normal pressure and at temperatures of 1700°, 1800° and 1900° C. FIGS. 1 to 3 are contained in "Stahl und Eisen" 88 (1968), pp. 155–156). Accordingly, for a chromium content of 18%, it is possible to decarbonize down to 0.22% C at 1700° C without loss of chromium, and down to 0.13%C at 1800° C and 0.08%C at 1900° C.

The chromium can be protected against oxidation by decarbonizing at reduced pressure, instead of increasing the temperature, because a low pressure modified the conditions of equilibrium of the reaction $$Cr_3O_4 + 4\,C = 3\,Cr + 4\,CO \qquad (1)$$

in such a manner as to favor the formation of carbon monoxide, i.e., so as to favor the oxidation of the carbon. FIG. 3 shows how this equilibrium shifts with the pressure at a temperature of 1800° C. Accordingly, at a chromium content of 18%, the decarbonization can be performed down to a carbon content of 0.07% at a pressure of 0.5 atm., and down to a carbon content of 0.02% at a pressure of 0.1 atm., without the occurrence of chromium oxidation.

If a vacuum decarbonization is performed, i.e. an oxidation of carbon at reduced pressure according to the reaction $$C + O = CO \qquad (2)$$

the oxygen balance of such a process must be taken into consideration, since the amount of oxygen that is required for the oxidation of the carbon has to be fed under a vacuum to the molten metal.

FIG. 2 is intended to explain this. It shows, in addition to the equilibrium curves computed for the stated pressures, concentrations and temperatures, a large number of experimental points. The concentrations of the points that lie around the equilibrium curves for a pressure of one atmosphere are adjusted in the decarbonization process at normal pressue. The contents of the points around the isobars for 0..1 atm. are achievable after vacuum decarbonizing in a large industrial degassing installation. The line *a–b* indicates the trend of the stoichiometric transformation of carbon and oxygen. The concentration movement under vacuum runs parallel to this line. If more carbon is to be removed in the vacuum then corresponds to this line, then additional oxygen must be put in during the vacuum treatment, over and above the oxygen that is dissolved in the molten metal after decarbonization at normal pressure, which is indicated in FIG. 3. The industrial use of a vacuum for the decarbonization of high-chromium molten metals is in the prior art and has been described in the literature. In this procedure, remelting furnaces such as vacuum-reduction furnaces are used (ef. "Die Hereaus-Vakummschmelzen; 1923–1933," published 1933, and "Giesserei" 53, (1966) pp. 229–234), and it has been proposed that high-carbon ferro-chrome be carbonized in an evacuated converter for the production of low-carbon ferro-chromium (German Pat. No. 675,565). The latter proposal has not yet been exploited industrially on account of the difficulties involved in the hermetic sealing of an entire converter.

In recent times proposals have been made for the use of large industrial steel degassing installations of the prior art (such as installations for siphon degassing, continuous-flow degassing, ladle degassing or degassing during tapping or teeming (cf. U.S. Pat. No. 3,335,132). Nothing is said, however, about the absolute necessity of supplying additional oxygen over and above the dissolved oxygen, and the difficulties arising out of this oxygen need, even though the decarbonizing capacities described are impossible of achievement without meeting this oxygen demand. In fact, it is even stated that the addition of solid oxygen carriers, such as iron ore, etc., has proven to be ineffective.

In the meantime, however, vacuum decarbonization with the addition of oxygen carriers in solid forms, such as iron ore or chromium ore, in a large industrial degassing installation, pertains to the state of the art. Relatively large quantities of oxidizing agents are used. On the assumption that the ores that are added are practically free of gangue, i.e., that they are pure $Fe_2O_3$ or $Fe_3O_4$, 4.5 to 5 kilograms of iron oxide have to be added for each kilogram of carbon. In the case of a 30 metric ton melt having a starting carbon content of 0.30%, approximately 90 Kg of carbon has to be oxidized out in order to achieve a final carbon content of 0.01%. The amount of oxide required for this purpose amounts to about 450kg. The amount of additional heat needed if such large quantities of ore are added is very great. The temperature losses during vacuum treatment amount to about 150° C in the case of a heat weight of 30 tons. It is quite possible to produce the necessary overheating of the metal in the furnace (e.g., arc furnace of LD converter) that precedes the vacuum treating equipment, but this entails intolerable wear on the refractory lagging in these furnaces, especially in the case of series production, since final temperatures of 1900° C and more must be reached before tapping. On the other hand, however, there is a technical interest in adjusting the carbon content to over 0.30% prior to the vacuum treatment, because, on the basis of FIG. 1, only when the carbon concentration amounts to more than this figure can the slagging of the chromium and hence undesired chromium losses be prevented when decarbonizing at normal pressure at low temperatures of less than 1700° C and at chromium contents of about 20%.

THE INVENTION

It is the aim of the present invention to make it possible to remove carbon at reduced pressure to carbon contents under 0.03%, especially under 0.02%, or preferably under 0.01%, without loss of chromium, without endangering the furnace that precedes the vacuum treating equipment.

These aims have commonly been impossible of achievement hitherto.

The invention specifically relates to such a process which utilizes the electric furnace primarily for melting, and post-melting treatment equipment primarily for post-melting treatment, whereby the overall efficiency of the process is substantially increased over the conventional practices of making ELC stainless steel in the furnace. The invention is particularly applicable to the treatment of ELC steel in large commercial batches of up to about 200 tons, and particularly in connection with electric furnaces which have adequate oxygen blowing capacity and fume control systems. As those skilled in the art will appreciate, the term Extra Low Carbon or ELC denotes a steel having a maximum carbon content of 0.03%, and that definition is intended wherever those terms appear in this specification and the claims.

In one embodiment of the new process, the manufacture of stainless chromium steel (herein "chromium steel" includes chrome-nickel steel) having very low carbon contents sets out from a molten iron having a high chromium or a high chromium and nickel content, the chromium content being about 10 to 35%, which is decarbonized to a carbon content of about 0.20 to 0.50% or slightly more, without substantially exceeding temperatures of about 1700° C. This molten metal is placed, at this temperature, or about 1580° and 1700° C, preferably between 1620° and 1670° C, into a vacuum apparatus, preferably one of the ladle degassing type, and is decarbonized under a vacuum with a blast of technically pure oxygen to carbon contents below 0.03%, especially below 0.02% and preferably below 0.01%, while regulating the burning rate of the carbon contained in the metal by producing a high kinetic energy in the jet of oxygen gas and using large quantities of oxygen, adjusting it to a value that will assure a steady production of heat to fully or substantially fully compensate the temperature losses of the molten metal and of the system during the likewise brief duration of the decarbonizing. Thus the invention provides a process for decarbonization of stainless chromium steel containing at least about 10% chromium. The process involves subjecting a melt of the steel at about 1580°–1700° C to vacuum and simultaneously blowing the melt with oxygen, for example by directing a jet of oxygen onto the surface of the steel. By the blowing, combustion of carbon is effected. The combustion compensates for heat loss during the blowing. It would be seen therefore, the invention involves a first stage wherein the melt is subjected to decarbonization, and a second stage, wherein further decarbonization is effected. Desirably, the carbon content is reduced from about 0.2 to 0.5% in said first stage.

EXAMPLE I

Figure 4:
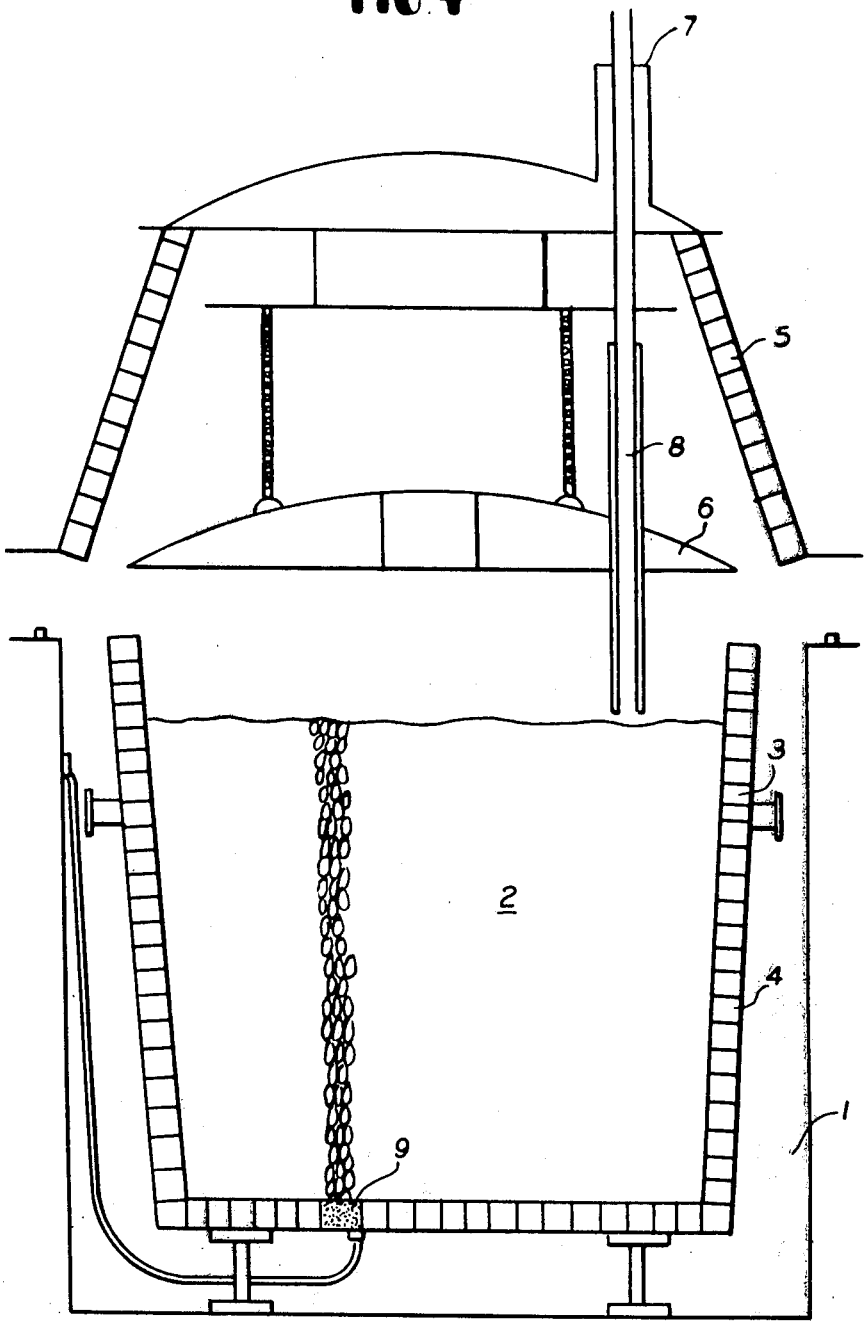

With reference to FIG. 4 (ladle degassing installation), the process of the invention is further described and additional preferred features are mentioned.

A crude molten iron containing 19 to 20% chromium and about 6% carbon was decarbonized in the LD crucible at normal pressure. When a carbon content of 0.4% was reached, the chromium content amounted to 18% and the bath temperature was 1680° C. This metal, which was contained in a conventional steel mill ladle 3 (FIG. 4) equipped with appropriate refractory lining 4, was placed in the ladle degassing tank 1 at a temperature of 1605° C. Then the cover 5 of the vacuum system was closed, the said cover being so constructed that, when the cover is lowered, a second cover 6, which is suspended from the first, automatically covers the ladle 3. An oxygen blowing lance 8 was introduced through a seal 7 in the cover of the vacuum apparatus 5. This lance, which consisted of a single steel tube jacketed with tubes of refractory material (or which can be constructed in the form of an LD blowing lance with a copper head and water cooling) is vertically movable in this seal, so that the distance between the lance orifice and the surface of the molten metal is adjustable. Oxygen was blown at high pressure of 15 to 20 atmospheres gauge pressure in the oxygen line onto the surface of the molten metal from the lance, which had an inside diameter of 30 mm. The oxygen input per unit of time amounted to about 20 Nm3 per minute. While the oxygen was being blown in, the bath was agitated by bubbling a current of neutral gas (argon) through a porous floor brick in ladle 9, so as to produce a circulatory movement of the molten steel.

One essential requirement for the proper operation of the process was a sufficient distance between the surface of the stirred molten metal in the ladle and the top edge of the ladle, amounting to about 1 meter, for the purpose of leaving sufficient free reaction room for the metal as it boiled up during the oxygen blowing.

The exothermic reaction between the carbon in the bath and the oxygen blown in, according to the eguation $$2\,[C] + O_2\ \text{gas} = 2\ CO\ \text{gas}, \qquad (3)$$

supported by a slight afterburning of the CO gas to $CO_2$, produced a temperature in the bath which remained uniform throughout the entire degassing period. The time during which the oxygen was blown in at about 20 Nm3/min amounted to about 5½ minutes. The principal data were accordingly the following:

| % C before vac. | % C after vac. | % Cr | Temperature ° C before vac. | after vac |
|---|---|---|---|---|
| 0.40 | 0.005 | 18.2 | 1605 | 1605 |

EXAMPLE II

A heat of molten metal on the order of 35–40 tons is prepared in a suitable pre-treatment melting unit. The heat may contain the complete chromium, nickel, nolybdenum, and optionally, the total manganese content desired in the final product. The heat should have carbon content substantially higher than the final carbon content desired.

For example, an average composition of the molten metal in the intermediate or pre-treatment condition suitable for production of an austenite chrome-nickel steel may have the following composition:

| % Chromium | % Nickel | % Carbon | % Manganese |
|---|---|---|---|
| 18/23 | 8.0/10.0 | 0.20/0.50 | 1.0/1.5 |

The temperature in the pre-treatment melting unit may be about 1700° C.

The heat of the above composition is tapped into a ladle of the type illustrated in FIG. 4 and placed into a vacuum chamber of a ladle degassing system of FIG. 4. After sealing the vacuum chamber and activating the vacuum system, the oxygen blowing process is begun.

The temperature of the molten metal may be about 1620° C at the commencement of the vacuum treatment. The oxygen blowing rate should be in the range of 300–450 SCFM with a 0.75 inch diameter lance. The distance between the lance and the surface of the heat may be in the range of about 20–40 inches, and the oxygen pressure in the oxygen supply tube may be on the order of 12 atm. or about 180 P.S.I.

The oxygen blow is started as soon as a pressure of about 0.2 atm. is reached in the vacuum chamber. The capacity of the pump system must be sufficient to ensure that the pressure in the system is continuously decreased the range of from about 2–5 torr even during those periods in which there is a high quantity of CO evolved from the surface of the heat. The final vacuum of about 2–5 torr will correspond roughly to a desired final carbon content of about 0.01 to 0.03%.

The exothermic reaction of the melted carbon with the source of oxygen, and the additional after burning of CO to $CO_2$ above the heat surface, will compensate for all the heat losses which normally take place in the conventional vacuum technique. As those skilled in the art will appreciate, such heat losses in a vacuum degassing system will normally cause a temperature loss of about 8° C per minute. However, the exothermic decarburizing vacuum treatment with the high energy oxygen jet completely compensates for this temperature drop.

In the above mentioned process, and after decarburizing of from 20–30 minutes, the carbon content will be lowered to 0.02%, and the temperature after the vacuum process will be 1620° C or more.

After the decarburizing vacuum treatment the composition and temperature of the melt will be as follows:

| % Chromium | % Nickel | % Manganese | % Carbon | Temperature |
|---|---|---|---|---|
| 18/23 | 8/10 | 1.0/1.5 | 0.02 | 1620° C |

It will be understood that the ferro-static pressure reduces the vacuum effect and accordingly portions of the molten metal remote from the surface must be transported into the upper region of the molten metal and near the surface to effectively practice the process. To bring about this desired circulation argon gas is bubbled upwardly through the molten metal through a porous plug from the bottom of the ladle, preferably at the rate of about 1.3/4 CFM. The pressure in the argon supply tube should be greater than the ferro-static head of the metal, and may, for example, be up to about 4 atms. If desired, the exothermic character of the process can be increased by having a small, but effective, quantity of an exothermic reacting element such as silicon or aluminum in the melt at the commencement of the oxygen treatment. For example, a content of about 0.10 % silicon will result in an increase in temperature of about 20° C measured at the commencement and termination of vacuum treatment.

EXAMPLES III–IX

Refer to the following Table 1 for EXAMPLES III–IX.

The procedure described above in connection with EXAMPLE II was followed with respect to each of EXAMPLES III–IX.

From the table it will be noted that the carbon content was lowered to the desired level irrespective of starting carbon content. Thus, in Heat V the initial carbon content of 0.20% was lowered to 0.01%, and likewise, in Heat IX the carbon content was lowered from 0.47% to 0.01%.

It should further be noted that the chromium loss was extremely small ranging from about 1% in EXAMPLE VII to about 3% in EXAMPLE IX.

It should further be noted that the temperature of the steel may be maintained substantially constant, or, if desired, increased at will irrespective of the beginning temperature and/or the length of the vacuum cycle. Thus, and with reference to EXAMPLES VIII and IX the temperature increased during the process 65° and 70° C respectively, the increase being attributable in part at least to an increase in the rate of oxygen flow. Further, it will be noted that even with a relatively short vacuum cycle of EXAMPLE IV and a relatively low oxygen blow rate, the temperature was increased 10° C.

TABLE 1

| ITEM: | HEAT: III | IV | V | VI | VII | VIII | IX |
|---|---|---|---|---|---|---|---|
| 1. Type of premelting unit (to BOF) | 30/40 | 30/40 | 30/40 | 30/40 | 30/40 | 30/40 | 30/40 |
| 2. % C - at tap | 0,28 | 0,24 | 0,20 | 0,21 | 0,30 | 0,37 | 0,47 |
| 3. % Cr - at tap | 18,49 | 21,10 | 19,52 | 19,42 | 18,90 | 18,92 | 19,53 |
| 4. % Si - at tap | traces | traces | traces | traces | traces | traces | traces |
| 5. % Mn - at tap | 1,23 | 1,10 | 1,23 | 1,06 | 1,31 | 1,43 | 1,80 |
| 6. % Ni - at tap | 9,49 | 8,78 | 10,04 | 9,92 | 9,73 | 10,56 | 9,19 |
| 7. Type of Steel | AISI 321 | 304 | 304 L | 304 L | AISI 321 | 304 L | 304 L |
| 8. Tap weight (kg) | 31 645 | 32 160 | 36 320 | 31 200 | 32 280 | 32 750 | 32 400 |
| 9. Temp. at tap (° C) | 1640 | 1650 | 1620 | 1675 | 1630 | 1585 | 1580 |
| 10. Time in vacuum tank (min) | 22 | 15 | 23 | 33 | 28 | 30 | 36 |
| 11. Time under about 12 mm Hg (min) | 17 | 11 | 15 | 24 | 20 | 5 | 5 |
| 12. Lowest Vac, mm Hg | <3 | <3 | <3 | <3 | <3 | <3 | <3 |
| 13. Time of 02 blow, min | 16 | 10 | 17 | 27 | 24 | 21 | 23 |
| 14. Rate of 02 blow, Nm3/h | 560 | 570 | 530 | 520 | 500 | 820 | 800 |
| 15. 02 Pressure (at) | 10 | 10 | 10 | 10 | 10 | 12 | 12 |
| 16. Lance diameter (inch) | 0,75 | 0,75 | 0,75 | 0,75 | 0,75 | 0,75 | 0,75 |
| 17. Lance - Melt Distance (mm) | ~800/ 1000 | 800/ 1000 | 800/ 1000 | 800/ 1000 | 800/ 1000 | 900 | 900 |
| 18. Purge gas, type | Argon | Argon | Argon | Argon | Argon | Argon | Argon |
| 19. Purge gas, rate, L/min | 45 | 55 | 45 | 50 | 60 | 45 | 60 |
| 20. Purge gas pressure (at) | 2,5 | 3,1 | 2,3 | 2,6 | 3,1 | 2,2 | 2,4 |
| 21. Time purge gas used (min) | 22 | 15 | 23 | 33 | 28 | 21 | 23 |

TABLE 1-continued

| ITEM: | HEAT: III | IV | V | VI | VII | VIII | IX |
|---|---|---|---|---|---|---|---|
| 22. % C - after treatment | 0,040 | 0,030 | 0,010 | 0,007 | 0,014 | 0,010 | 0,010 |
| 23. % Cr - after treatment | 17,94 | 20,47 | 19,10 | 18,82 | 18,70 | 18,55 | 18,92 |
| 24. % Si - after treatment | 0,00 | 0,00 | 0,00 | 0,00 | 0,00 | 0,00 | 0,00 |
| 25. % Mn - after treatment | 1,05 | 0,82 | 0,78 | 0,67 | 1,13 | 1,01 | 1,39 |
| 26. % Ni - after treatment | 9,62 | 8,85 | 9,95 | 9,87 | 10,06 | 10,67 | 9,20 |
| 27. Temp. - after treatment | 1650 | 1660 | 1640 | 1665 | 1640 | 1650 | 1650 |
| 28. % Cr - loss | 2.97 | 2.99 | 2.15 | 3.09 | 1.07 | 1.85 | 3.13 |

From the above data, and particularly EXAMPLES VIII and IX it will be seen that the ability to maintain or increase the temperature of the steel during the vacuum treatment makes possible the use of a relatively low tapping temperature, around 1580°–1585° C for example, which in turns causes minimal wear on the melting unit refractories and accordingly maximum melting unit refractory life.

Figure 5:
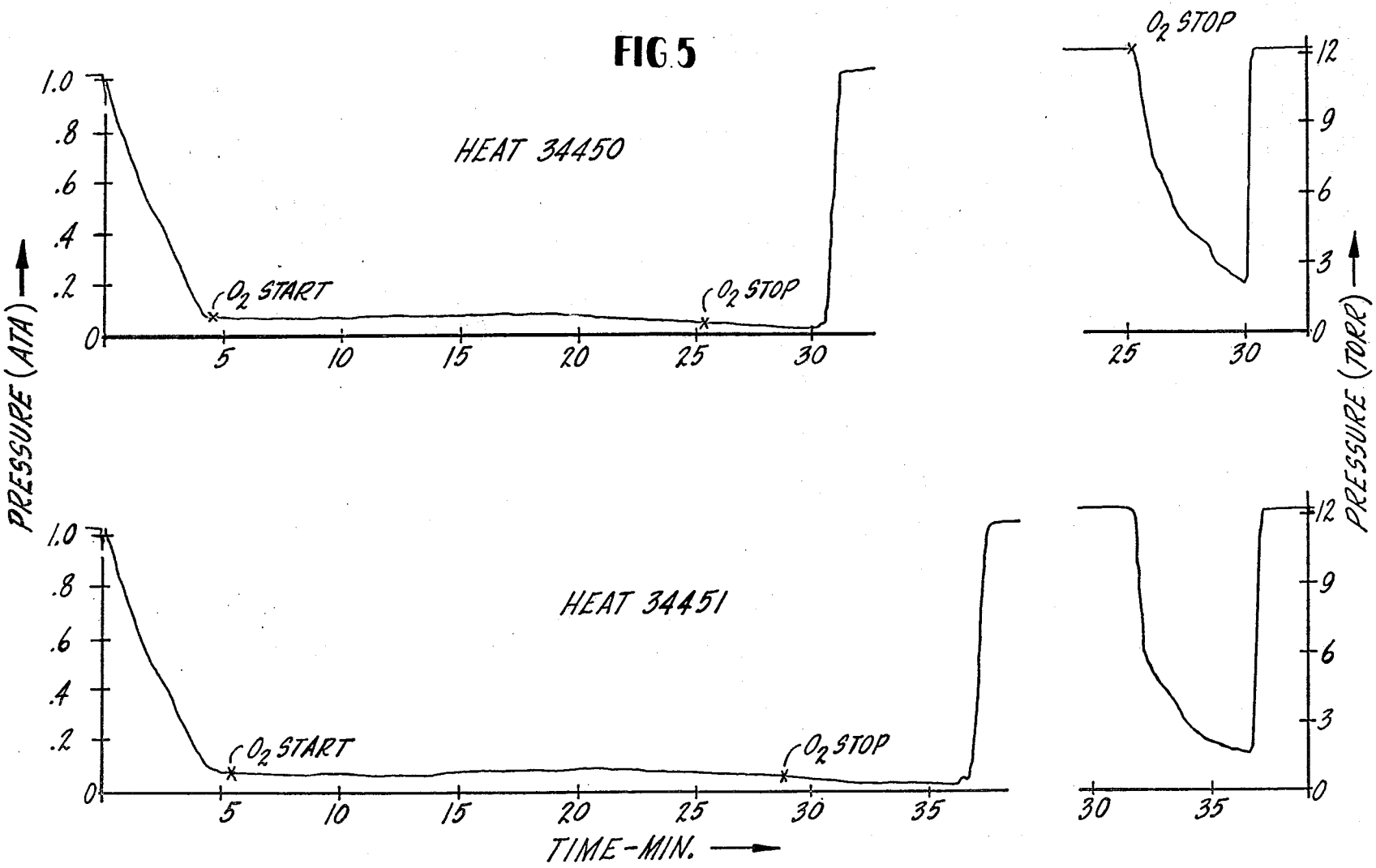

Further vacuum date is shown in FIG. 5, which illustrates actual readings recorded during the running of the vacuum treatment portion of the total treatment cycle of cycles analogous in all respects to those of EXAMPLES I–IX.

In heat 34450 it will be noted that a final vacuum of approximately 2 torr absolute was reached, whereas in heat 34451 a final vacuum of approximately 1.1/2 torr absolute was reached. It will be understood that the vacuum recording instrument for the gross vacuum curves, that is, the full cycle curve shown on the left of each of the curves in the Figure, is incapable of measuring into the milimeter range when vacuums of 10–15 Hg absolute are reached. Accordingly the supplemental expanded pressure scale curve shown at the right of each curve, which represents recording data taken from a fine vacuum recording instrument, is a more accurate representation of the lowest vacuum values reached. It will be noted that the time span specified in each of the supplemental expanded pressure scale curves illustrates the same time span as is illustrated by the corresponding time reference numerals on the corresponding full cycle curves.

Although the foregoing described data refers to vacuum levels of less than 12 mm Hg, and usually in the 2–5 mm Hg range, recent work indicates that vacuum levels of up to 30 mm Hg are feasible, with very acceptable results occurring in the 20–30 mm Hg range.

It should be understood that the time during which an oxidizing medium is added to the molten metal need not be co-extensive, or co-terminous, with the time the molten metal is subjected to the vacuum. Referring to the heats illustrated in FIG. 5, for example, addition of the oxidizing medium to the melts (in these instances an oxygen blow) did not commence until a pressure below 0.2 atm was reached, and terminated 5 to 8 minutes before the vacuum was broken.

Decarbonization continued after termination of the oxygen blow and prior to breaking vacuum by virtue of the presence of oxygen dissolved in the molten metal.

In an alternative embodiment of the invention, decarbonization of the metal by reason of oxygen dissolved in the molten metal is relied on entirely for decarbonization during the vacuum portion of they cycle, thereby eliminating entirely the necessity of blowing oxygen under vacuum.

This embodiment of the invention is described generally as follows.

EXAMPLE X

Conventional charge materials, such as 18-8 scrap, etc., are charged into the electric furnace in a conventional manner. It should be noted that the phrases "conventional charge materials", "charge materials" and terms of similar import are used in this specification and the claims in the sense they would be understood by those skilled in the art; i.e.: no special meaning is attributed to them. For example, "conventional charge materials", when used in the context of electric furnace steelmaking connotes a large, or total percentage of solid scrap of a composition compatible with the product to be made or, as defined in a standard text, "An Encyclopedia Of The iron And Steel Industry", compiled by A. K. osborne, published 1956, Philosophical Library, the total ore, pig iron, scrap, limestone and so forth, introduced into a melting furnace for the production of a single heat of steel. The charge is melted down with the furnace arcs until the charge is at least about 90–95% molten, or entirely with the furnace arcs. The charge may be so selected that chromium and, if required, nickel, are as close to specification as possible, and, although this is preferred, it is not essential. It is important, however, that chromium be substantially to specification at tap; only minor chromium adjustment is contemplated subsequent to tap.

After melt down the melt is blown with gaseous oxygen until the carbon is in the range of about 0.1% or less, and preferably into the range of about 0.06–0.08C. As those skilled in the art will appreciate, it is a relatively simple task in the electric furnace to lower the carbon content from an elevated value, even up to about 1% and more, down to about 0.1% carbon, it is exceedingly difficult, if not impossible, costly, and time-consuming to lower the carbon content from the 0.06–0.08 range into the ELC range, at least under atmospheric pressure conditions in the electric furnace and, particularly, when the bath chromium is near specification in the common stainless grades.

Preferably the gaseous oxygen blow does not commence the temperature of the melt has reached about 2900° F.

After the carbon has been reduced to about 0.06 to 0.1%, a standard reduction mix may be addes to reduce the chromium oxidized during the oxygen blowing period. Thereafter the first slag is removed and then a finish slag, preferably lime and spar, may be added. Final furnace additions may then be made.

In order to ensure that there will be enough oxygen available to carry the subsequent vacuum degassing treatment to a point where the carbon level is in the ELC range the melt may again be blown with oxygen. One guideline for determining whether the above conditions have been obtained is to adjust the silicon content to about 0.25% or less, and preferably to an aim of 0.20% Si. A silicon content of this magnitude together with an appropriate temperature level, which may for example be on the order of about 3100° to 3200° F, ensures a solution level of oxygen sufficiently high to enable the process to go to completion in the vacuum treatment unit without the addition of an external heat source, at least in heats in the magnitude of about 80–200 tons.

The melt is tapped at a temperature in the range of from about 3100° to about 3200° F, the lower limit being the temperature necessary (a) to satisfy the temperature requirement of the temperature, pressure, and chemical relationships necessary to enable the process to go to completion in the subsequent vacuum treatment step, and (b) to ensure that the metal will be within the proper teeming range at the conclusion of the process. The upper temperature is the approximate upper limit of the economically useful life of the refractories.

A description of the required equilibrium relationships that must be observed to enable the process to be successfully practiced may be found in the article "Production of High Alloy Special Steels in the Basic Oxygen Converter", Stahl und Eisen, 1968, Volume 88, pp. 153–168, see particularly pp. 155–156, and also "The Production of Low Carbon Stainless Steels by the VOD Process", 30th Electric Furnace Conference, December, 1972.

Either before or after tap, and preferably before tap, the metal is slagged off to the greatest extent possible so that the metal is in a substantially slag-free condition prior to subjection to vacuum treatment. If desired, chemistry adjustments can be made just prior to subjection to vacuum.

After tap the substantially slag-free metal is placed in a vacuum degassing treatment unit in an appropriate treatment vessel. Preferably the vessel is of the lip-pour type, or is equipped with a sliding gate nozzle in lieu of a conventional refractory stopper system, which system may pose a potential danger of breakouts in the vacuum tank.

The metal in the treatment vessel is subjected to a vacuum of a magnitude below the equilibrium requirement of the chemical, temperature and pressure relationships necessary to carry out the process to completion. In a 200 ton system, for example, the vacuum should be maintained in or below the range of about 30–50 mm Hg absolute for from about 10 to 35 minutes, and preferably the vacuum should be maintained at about 1 mm Hg absolute or below for about 5–30 minutes. At these vacuum levels in a progressively decreasing vacuum cycle, carbon is the only element which will be oxidized.

It will be understood that the oxygen necessary to maintain the carbon monoxide boil during vacuum treatment is derived from the substantial quantities of oxygen in solution at tap; indeed, the metal may be saturated or super-saturated with oxygen.

In certain cases, primarily as a safety measure, as for instance to compensate for an unduly high silicon content and when adequate temperature is available, the oxygen level may be supplemented by addition of solid oxides such as taconite ore or mill scale.

To assist the carbon monoxide reaction so that the carbon level is lowered throughout all portions of the melt a purging gas is passed upwardly from a location beneath the surface of the melt during the vacuum treatment. The purging gas, due to the Boyle's and Charles' laws expansion effects and the substantial, or complete, absence of slag at the surface will result in a vigorous boil at the surface which facilitates removal of the CO gas and creation of an internal circulation which brings metal in remote portions of the vessel to the surface.

Chemical adjustments may be made under vacuum if desired.

Preferably, the metal is contained in a vessel which provides a minimum of about 4 feet of free-board to ensure containment of the boil.

Vacuum treatment of the melt should commence when the temperature of the melt is in the range of from about 3,000° to about 3,100° F, and this is the preferred beginning treatment temperature. This temperature is necessary in order that a vacuum cycle time of up to about 45 minutes be available, and that the temperature will remain within the equilibrium relationships. This temperture level also ensures that the temperature of the metal will be in the required teeming temperature range which may, for example, be about 2,720°–2,740° F or above for 304L and 316L grades. It will be understood that the desired teeming temperature may vary with the grade.

It should be noted that the temperature and pressure existing at any moment in the vacuum treatment cycle should be, if at all possible, of a magnitude which will provide a driving force tending to favor carbon reduction for the carbon and chromium levels which exist in the melt. In other words, the temperature should be higher and/or the pressure should be lower than the equilibrium temperature and/or pressure conditions required for the carbon and chromium contents which exist at any given moment.

If desired, further chemical adjustments may be made subsequent to vacuum treatment, including lowering the oxygen in solution by addition of aluminum or other deoxidation agents.

In the event the metal is still too hot at the termination of the process the appropriate teeming temperature can be obtained by extending gas bubbling treatment, either under vacuum or in air, reladling, or even scrap additions, or a combination thereof.

Preferably a synthetic slag, such as vermiculite, is added to the bath surface after treatment to retard temperature loss and prevent contamination from the atmosphere.

It will thus be noted that the furnace process produces steel in an ideal condition for carbon reduction. At the termination of furnace treatment the bath is hot, the solution level of oxygen is high, and whatever slag may be present is quite fluid.

It will also be noted that the vacuum treatment portion of the full cycle is essentially a degassing operation, since the oxygen content of the melt is very substantially lowered from beginning to end of vacuum treatment.

Specific examples are set forth in Tables 2, 3, and 4, for heat sizes in the range of about 80–200 tons.

Table 2

EXAMPLES XI-XVII

| | HEAT NO. | GRADE | C | Mn | P | S | Si | Ni | Cr* | Mo | Al | Total Product Weight, Tons |
|---|---|---|---|---|---|---|---|---|---|---|---|---|
| A. | 8684792 | 304L | .018 | 1.63 | .031 | .016 | | 10.20 | 18.45 | .32 | .009 | 166.8 |
| B | 8684740 | 316L | .008 | 1.90 | .038 | .013 | .65 | 13.15 | 17.18 | 2.09 | .014 | 146.3 |
| C | 8684617 | 316L | .016 | 1.77 | .032 | .016 | .57 | 13.42 | 17.31 | 2.10 | .011 | 158.5 |
| D | 8684584 | 304L | .010 | 1.89 | .034 | .011 | .90 | 10.20 | 18.45 | .38 | .012 | 157.9 |
| E | 8650847 | 316L | .018 | 1.61 | .033 | .019 | .51 | 13.18 | 16.85 | 2.11 | .013 | 82.5 |
| F | 8684827 | 316L | .010 | 1.75 | .028 | .017 | .45 | 13.25 | 17.25 | 2.10 | .012 | 172.4 |
| G | 8684829 | 316L | .010 | 1.59 | .027 | .013 | .40 | 13.42 | 17.06 | 2.18 | .013 | 173.9 |

*Apparent decrease in Cr (See Table 2, Tap Chemistry, Cr) due to dilution effect of Post Tap Additions.

TABLE 3

| HEAT | GRADE | Charge Chemistry C | Mn | S | Si | Cr | Tap Chemistry C | Mn | S | Si | Cr | Tap Temp., °F. |
|---|---|---|---|---|---|---|---|---|---|---|---|---|
| A | 304L | .730 | .65 | .022 | .06 | 18.60 | .069 | .49 | .015 | .19 | 18.80 | 3160 |
| B | 316L | .748 | 1.31 | .029 | .04 | 18.30 | .049 | .94 | .013 | .11 | 17.22 | 3160 |
| C | 316L | .185 | .72 | .024 | .11 | 14.98 | .083 | .480 | .020 | .16 | 17.87 | N.A. |
| D | 304L | .333 | .80 | .024 | .01 | 16.60 | .065 | .47 | .012 | .11 | 18.80 | 3180 |
| E | 316L | .299 | .56 | .032 | .03 | 15.90 | .050 | .46 | .020 | .11 | 17.45 | 3200 |
| F | 316L | .250 | .48 | .033 | .07 | 15.80 | .074 | .31 | .017 | .11 | 17.39 | 3120 |
| G | 316L | .715 | .84 | .019 | .30 | 17.00 | .067 | .48 | .013 | .15 | 17.08 | 3190 |

TABLE 4

| | | Temp °F | | Vacuum Cycle Time, Min. | | | Purge Gas (Ar.) | | | | | Post Tap Additions, No. | | | | | |
|---|---|---|---|---|---|---|---|---|---|---|---|---|---|---|---|---|---|
| Heat | Grade | Before Vac. | After Vac. | Total | Under 40 MM | Under 1 MM | PSI | CFM | Slag Cond. | Boil Action | Free-Board, Ft. | .10 Mn | 75% Si | Ni Mn | Fe Mo | Flake Mn | .10 Cr |
| A | 304L | 3090 | 2840 | 24 | 13 | 5 | 95 | 10 | Light | Heavy | 4 | 2700 | 1900 | 1600 | 0 | 0 | 0 |
| B | 316L | 3075 | 2800 | 35 | 27 | 21 | 90 | 17/5 | Light | Heavy | 4+ | 2500 | 2400 | 1450 | 0 | 0 | 1200 |
| C | 316L | 3025 | 2840 | 40 | 33 | 26 | 95/90 | 12/10 | None | Heavy | 4–½ | 3000 | 98./ 1800 | 1800 | 400 | 500 | 0 |
| D | 304L | 3005 | ES N.A. | 30 | 23 | 14 | 50/40/ 35 | 14/ 12.5 | None | Heavy/ Light | 5 | 0 | 98./ 2500 | 1500 | 0 | 3600 | 3000 |
| E | 316L | 3140 | 2940 | 40 | 35 | 18 | 60 | 8/12 | Heavy | Heavy | 4 | 2640 | 1100 | 0 | 0 | 0 | 0 |
| F | 316L | 3060 | 2790 | 44 | 34 | 29 | 95 | 10/20 | Neg. | Heavy | 4 | 3800 | 1900 | 1600 | 800 | 0 | 500 |
| G | 316L | 3075 | 2760 | 38 | 30 | 19 | 90 | 12/15 | Neg. | Heavy | 5 | 3350 | 2000 | 1600 | 0 | 200 | 2090 |

Table 2 shows that large, commercial sized heats of Extra Low Carbon stainless steels can be successfully made by the disclosed process since the final carbon content was in the ELC range of .03% max. in heats of about 80 to about 200 tons in size.

Table 3 gives pertinent data connected with the furnace treatment portion of the cycle. It shows that furnace carbon levels may be lowered from about 0.7% range to the range of less than about 0.1% at tap, and preferably into the 0.05–0.09% range.

It will be noted that the tap temperature was in the range of about 3,100° – 3,200° F which, together with the high solution level of oxygen of the bath, ensured achievement of the desired final low carbon value.

Table 4 contains pertinent data relating to the vacuum treatment portion of the cycle. All heats were vacuum treated to obtain final carbon contents in the ELC range; indeed final carbons did not exceed the 0.025% max. limit. It will be noted that it was possible to achieve a before-vacuum temperature of about 3,000° to about 3,100° F.

It will also be noted that for the range of heat size disclosed, namely from about 80 to 200 tons, a 25–45 minute cycle appears quite adequate for the intended purpose.

Chromium recovery during the vacuum treatment cycle varied from the high 90's to 100%, which, as those skilled in the art will appreciate, is an excellent recovery ratio.

A description of a specific heat, in this instance heat B, is as follows.

A charge of conventional stainless steel scrap was melted down in the arc furnace.

After melt-down, and when the charge was substantially, if not entirely, molten, gaseous oxygen was blown on the melt from lance means in the furnace.

The first slag was removed about 5 hours after charging ended, and 12,500 lbs. of lime and 3,000 lbs. of spar added after slag-off for refining purposes.

Thereafter, final furnace additions were made which included, in this instance, 0.10 chromium and 75% silicon.

After determining the carbon had reached the appropriate level of about 0.05%, gaseous oxygen was blown on the melt, which resulted in the silicon content being decreased from about 0.32 to about 0.11, with an accompanying temperature increase and high solution level of oxygen in the melt.

As those skilled in the art will appreciate, the purpose of addition of silicon alloys prior to the first slag-off is to revert the chromium in the slag back to the bath; this may result in excess silicon in the bath. This silicon content is lowered by the oxygen made available by the oxygen blow to the point where the silicon will not inhibit the later carbon monoxide boil.

On occasion, as where a heat is quite hot, for example, the final oxygen blow may be omitted.

The first slag-off removes the slag generated during the early stages of the process. The second slag-off, which occurs after addition of lime and spar, is for the purpose of removing slag containing excess sulphur and to condition the melt for subsequent vacuum treatment.

The melt was tapped at a temperature of about 3,160° F and transferred to a vacuum treatment station consisting of a vacuum tank having a multi-stage steam ejector system capable of carrying the absolute vacuum level down to less than about 1 mm Hg in approximately 10 minutes. The melt was in a substantially slag free condition at the commencement of vacuum treatment. Temperature before vacuum treatment commenced was 3,075° F, thus indicating a loss of about 85° F from tap to start of vacuum.

As soon as the vacuum chamber was made airtight the vacuum system was started. Likewise a purging gas, in this instance argon, was passed upwardly through a porous member located in the central portion of the bottom of the ladle under a pressure of about 90 psig and a flow rate of 17 to 5 CFM. A heavy spraying boil was observed in the vessel, which had a freeboard of about 4 feet.

Within about 8 minutes of the commencement of vacuum, the absolute pressure in the tank reached 40 mm mercury, and about 5 minutes later the 1 mm range was reached. After 35 minutes the vacuum was terminated, the vacuum being 440 microns at the time of termination.

Throughout the vacuum purging period a heavy to medium spraying boil was observed.

During the degassing cycle, in this instance while under vacuum, additions consisting of 1,200 lbs. of 0.10 chromium, 2,500 lbs. of 0.10 manganese, 2,400 lbs. of 75% silicon, and 1,450 lbs. of nitrogen manganese were added while a gas purge was maintained. After the degassing cycle ten bags of vermiculite were placed on the surface of the melt to form a synthetic slag cover which slowed contamination of the steel from the atmosphere and heat loss during teeming.

A temperture reading of 2,800° F was taken 54 minutes after the start of the degassing cycle. Since this was too high the purging was continued for 10 minutes, and another temperature reading of 2,775° F was taken. Since this was still too high, the steel was gas purged for another 26 minutes, at which time a reading of 2,720° F was obtained, and accordingly the pouring pit operation was carried out.

An addition of silicon at the end of the degassing cycle was made to lower the solid solution level of the oxygen and meet specifications.

Three further 50–55 ton heats processed by the above method gave the following results which are summarized in Table 5.

Table 5

| Heat | | C | Cr | Mi | emp, , ° C |
|---|---|---|---|---|---|
| H | Before Vacuum | .080 | 18.22 | 12.17 | 1760 |
| H | After Vacuum | .014 | 18.00 | 12.21 | 1670 |
| J | Before Vacuum | .09 | 21.02 | 6.59 | 1780 |
| J | After Vacuum | .02 | 20.58 | 6.76 | 1670 |
| K | Before Vacuum | .14 | 19.02 | 10.08 | 1790 |

Table 5-continued

| Heat | | C | Cr | Mi | emp, , ° C |
|---|---|---|---|---|---|
| K | After Vacuum | .024 | 18.45 | 10.15 | 1660 |

A free board of about 1 meter was used in each of the above heats.

In Heat H the boil became lively at about 40 Torr. For about the next 6 minutes this lively boil proceeded at a pressure between 20 and 40 Torr. The pressure dropped to less than 10 Torr thereafter.

In Heat J a vacuum of about 40 Torr was reached 5 minutes after commencement of vacuum, reached 10 Torr in 12 minutes, 6 Torr in 13 minutes, 2 Torr in 15 minutes and was less than 2 Torr when the vacuum cycle ended in 18 minutes.

In Heat K a vacuum of about 40 Torr was reached 7 minutes after commencement of vacuum, 10 Torr in 14 minutes, 6 Torr in 15 minutes, 2 Torr in 16 minutes, and was less than 2 Torr at the 18 minute mark and finished at 1 Torr after 19 minutes.

DISCUSSION

The performance of the process is not dependent on the use of ladle degassing, though this is preferred; instead, it can be performed in other vacuum apparatus, such as siphon degassing apparatus, continuous stream degassing systems, apparatus which degas the teeming or tapping stream, or vacuum induction furnace equipped with sufficient pump capacity; in the case of equipment which does the degassing by batches, the oxygen feed must be coordinated with the size of the batch that is under the vacuum.

Neither does the process depend on the premelting unit in which the metal to be decarbonized is prepared for the process in regard to its composition and temperture. For example, the arc furnace, the LD converter, or the induction furnace can be used as the premelting unit.

Variations in the practice of the new process are also possible. For example, a certain portion of the gaseous oxygen may be replaced by bound oxygen. It should be noted that the phrase "bound oxygen" and terms of similar import are used in this specification and the claims in the sense they would be understood by those skilled in the art; i.e.: no special meaning is attributed to them. For example, "bound oxygen" when used in the context of electric furnace steelmaking connotes use of oxygen which is chemically combined with another substance, which other substance will usually be a solid material such as ore. For example, ore may be added during tap or under vacuum to provide a supplemental source of oxygen. It is also possible to add substances having a strong exothermic reaction, such as aluminum or silicon, for the purpose of affecting the heat balance. If desired, the same method can be used to produce temperature rises above the starting temperature in the vacuum, and an additional means for this purpose can be a higher initial carbon content in the metal when it is placed in the vacuum, e.g., a content even in excess of 0.50%.

It will thus be seen that a method of making large batches, that is batches of steel in the 30–200 ton range, of Extra Low Carbon stainless steel has been provided in which vacuum treatment is used to lower the carbon content from a range of about 0.05 to 1% carbon into the ELC range without the addition of external heat during the vacuum process, and with a chrome recovery which approaches or reaches 100%. The process is easily controlled since an observer can determine when carbon removal has effectively terminated by observing when the boil in the vacuum tank subsides. The process is extremely flexible, since additions can be made before vacuum, during vacuum, after vacuum, or in air after vacuum. No reduction mix need be added to the metal in the vacuum tank, and accordingly no vacuum tank slag is formed.

Although several embodiments have been described, it will be apparent to those skilled in the art that further modifications may be made within the spirit and scope of the invention. Accordingly, it is intended that the scope of the invention is limited, not by the scope of the foregoing description, but rather by the foregoing description as interpreted in view of the pertinent prior art.

We claim:

1. In a method of making stainless steel, the steps of melting solid charge material, including stainless steel scrap under substantially atmospheric pressure and environmental conditions whereby, upon completion of melting, a molten charge is obtained, pouring said molten charge, including the melted solid charge material obtained in the preceding step, into a treatment vessel having sufficient freeboard to contain the violent disruption of the upper exposed surface of the molten charge which is thereafter induced, said molten charge having about 10–35% Cr, and C in an amount substantially greater than the final desired amount, adding oxygen to the aforesaid molten charge to supersaturate the charge with oxygen, exhausting the atmosphere above the surface of the molten charge to thereby subject the upper, exposed surface of the molten charge to a vacuum, subjecting the molten charge to an absolute pressure of a magnitude which causes the $C + O = CO$ reaction to be preferential to the $3Cr + 4O = Cr_3O_4$ reaction down to and including the desired carbon level, continuously violently disrupting the upper, exposed surface of the molten charge which is subject to the aforesaid low absolute pressure, continuously replenishing the violently disrupted surface by vigorously circulating molten metal remote from the surface to the violently disrupted surface by admission of a stirring gas to the lower region of the vessel, and maintaining said violent surface disruption and vigorous internal circulation during the time the molten charge is exposed to the vacumm which causes the $C + O = CO$ reaction to be preferential to the $3Cr + 4O = Cr_3O_4$ reaction.

2. The stainless steel making method of claim 1 further characterized in that the oxygen which is added to the molten charge is derived from a substance in the group consisting essentially of gaseous oxygen and a mixture of gaseous oxygen and bound oxygen.

3. The stainless steel making method of claim 2 further characterized by and including the step of subjecting the molten charge to decarbonization treatment prior to exhaustion of the atmospher above the surface of the charge whereby the upper exposed surface of molten charge is exposed to a vacuum.

4. The stainless steel making method of claim 3 further characterized in that the C content of the molten charge is decreased into the range of about 0.2 to 0.5% in said prior decarbonization treatment.

5. The stainless steel making method of claim 4 further characterized in that the prior decarbonization step is effected by directing a jet of oxygen in gaseous form against the surface of the molten charge.

6. The stainless steel making method of claim 5 further characterized by and including the step of adding a strongly exothermic reacting agent to the molten charge prior to termination of the aforesaid absolute pressure which produces the preferential CO reaction.

7. The stainless steel making method of claim 4 further characterized in that the molten charge is subject to the aforesaid absolute pressure which causes the $C + O = CO$ reaction to be preferential to the $3Cr + 4O = Cr_3O_4$ reaction until the carbon level is no greater than 0.03%.

8. In a method of making stainless steel, the steps of melting solid charge material, including stainless steel scrap under substantially atmospheric pressure and environmental conditions whereby, upon completion of melting, a molten charge is obtained, pouring said molten charge, including the melted solid charge material obtained in the preceding step, into a treatment vessel having sufficient freeboard to contain the violent disruption of the upper exposed surface which is thereafter induced, said molten charge having about 10–35% Cr, and C in an amount substantially greater than the final desired amount, exhausting the atmosphere above the surface of the molten charge to thereby subject the upper exposed surface of the molten charge to a vacuum, subjecting the molten charge to an absolute pressure of a magnitude which causes the $C + O = CO$ reaction to be preferential to the $3Cr + 4O = Cr_3O_4$ reaction down to and including the desired carbon level.

violently disrupting the upper, exposed surface of the molten charge which is subjected to the aforesaid low absolute pressure, continuously replenishing the violently disrupted surface by vigorously circulating molten metal remote from the surface to the violently disrupted surface by admission of a stirring gas to the lower region of the vessel, maintaining said violent surface disruption and vigorous circulation during the time the molten charge is exposed to the vacuum which causes the $C + O = CO$ reaction to be preferential to the $3Cr + 4O = Cr_3O_4$ reaction, and adding a quantity of gaseous oxygen to the violently disrupted surface of the molten charge sufficient to lower the carbon content into the extra low carbon range simultaneously with (a) subjection of the upper exposed surface to the aforesaid low preferential absolute pressure, (b) the violent disruption of the upper exposed surface, (c) and the vigorous internal circulation of the molten charge material.

9. The stainless steel making method of claim 8 further characterized in that the C in the molten charge is a maximum of about 0.2–0.5% prior to the simultaneous subjection of the upper exposed surface to the low preferential absolute pressure, the violent disruption of the upper exposed surface, and the vigorous internal circulation of the molten charge.

10. The stainless steel making method of claim 1 further characterized by and including the step of adding a strongly exothermic reacting agent to the molten charge during the maintenance of the absolute pressure which causes the $C + O = CO$ reaction to be preferential to the $3Cr + 4O = Cr_3O_4$ reaction.

11. The stainless steel making method of claim 10 further characterized in that the molten charge is subjected to the aforesaid low absolute pressure which causes the $C + O = CO$ reaction to be preferential to the $3CR + 4O = Cr_3O_4$ reaction until the carbon level is no greater than 0.03%

12. In an electric furnace method of making large batches of extra low carbon stainless steel, the steps of melting solid charge materials under substantially atmospheric pressure and environmental conditions whereby, upon completion of melting, a molten charge is obtained containing Cr and, if required, Ni, conditioning the molten charge in the melting vessel under substantially atmospheric pressure conditions to lower the C content into the range of less than about 0.10% C, adjusting the Si content if above 0.25% after conditioning to about 0.25% or less by addition of oxygen to thereby ensure a solution level of oxygen sufficiently high to enable the process to go to completion in the vacuum treatment unit without the addition of an external heat source, tapping the melt at a temperature high enough to achieve the necessary chemical, temperature and pressure relationships in the subsequent vacuum treatment step, slagging off the molten charge, subjecting the molten charge in a substantially slag free condition to the stirring and agitating effect of a purging gas which is passed upwardly from a location beneath the surface of the melt in the presence of an absolute pressure of a magnitude which causes the $C + O = Co$ reaction to be preferential to the $3Cr + 4O = Cr_3O_4$ reaction which may exist in the molten charge at any given moment until the C is lowered into the 0.03 C maximum range, and, subsequent to vacuum treatment, subjecting the molten charge to further treatment steps, including as required, chemical and temperature adjustment, and pouring from the vacuum treatment vessel;

13. In an electric furnace method of making stainless steel having a maximum C content of 0.025%, the steps of charging an electric furnace, said furnace charge including stainless steel scrap, forming a molten charge in the electric furnace by arc heat under substantially atmospheric pressure and temperature conditions, said molten charge having a carbon content greater than 0.1%, raising the temperature of the molten charge to a minimum of about 2900° F, blowing the molten charge with gaseous oxygen after the temperature reaches a minimum of about 2900° F and after the molten charge is in a substantially entirely molten condition, maintaining the gaseous oxygen flow in the electric furnace until the C is lowered into the 0.05 to 0.1% range from the level existing after said molten charge was formed under substantially atmospheric pressure and temperature conditions as aforesaid, chemically reducing Cr oxidized during said gaseous oxygen blow period back to the molten charge, lowering the Si content of the molten charge if above 0.25% to about 0.25% or less, said decrease in Si content being achieved by blowing the molten charge with gaseous oxygen, tapping the molten charge with Cr, substantially in the required amount in the temperature range of about 3100° to 3200° F, slagging off the molten charge, subjecting the molten charge in a substantially slag free condition and at a temperature in the range of from about 3000° to 3100° F to vacuum treatment for a period of time of up to about 45 minutes, said vacuum treatment including subjection to a vacuum below the equilibrium level for the C-Cr-temperature-pressure conditions which exist at tap and thereafter as C reduction proceeds, and in any event in the range of about 50mm Hg or less for up to about 35 minutes, and passing a purging gas upwardly through the molten charge from a location beneath the surface thereof to maintain a vigorous boiling action at the surface and create an internal circulation which brings metal in remote portions of the vacuum treatment vessel to the surface, terminating the simultaneous vacuum purging gas treatment after the C reaches 0.025%, and conditioning, as needed, including chemical and temperature adjustments.

* * * * *